US011020990B2

(12) United States Patent
Zaizen et al.

(10) Patent No.: US 11,020,990 B2
(45) Date of Patent: Jun. 1, 2021

(54) IMAGE PRINTING APPARATUS AND CONTROL METHOD THEREFOR

(71) Applicant: CANON KABUSHIKI KAISHA, Tokyo (JP)

(72) Inventors: Naoki Zaizen, Kyoto (JP); Takakazu Ohashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/800,198

(22) Filed: Feb. 25, 2020

(65) Prior Publication Data

US 2020/0189297 A1 Jun. 18, 2020

Related U.S. Application Data

(62) Division of application No. 16/257,663, filed on Jan. 25, 2019, now Pat. No. 10,611,177.

(30) Foreign Application Priority Data

Jan. 31, 2018 (JP) ..... JP2018-014535
Dec. 21, 2018 (JP) ..... JP2018-239680

(51) Int. Cl.
*B41J 11/00* (2006.01)
*B41J 13/00* (2006.01)

(52) U.S. Cl.
CPC ..... *B41J 11/0095* (2013.01); *B41J 11/009* (2013.01); *B41J 11/0065* (2013.01); *B41J 13/0009* (2013.01)

(58) Field of Classification Search
CPC ... B41J 11/0095; B41J 11/0065; B41J 11/009; B41J 11/02; B41J 11/04; B41J 13/0009
See application file for complete search history.

(56) References Cited

U.S. PATENT DOCUMENTS 7,637,590 B2 12/2009 Jeong et al.
8,186,824 B2 5/2012 Fujita
(Continued)

FOREIGN PATENT DOCUMENTS

CN 1868746 A 11/2006
CN 105785730 A 7/2016
(Continued)

OTHER PUBLICATIONS

Jun. 14, 2019 European Search Report in European Patent Appln. No. 19152561.7.
(Continued)

*Primary Examiner* — Jason S Uhlenhake
(74) *Attorney, Agent, or Firm* — Venable LLP

(57) ABSTRACT

A conveyance unit of an image printing apparatus includes a conveyance member configured to nip and convey the print medium and disposed upstream of the print head in the conveyance direction but does not include a conveyance member configured to nip and convey the print medium and disposed downstream of the print head in the conveyance direction. In a case where a trailing edge margin length indicated by the trailing edge margin information is shorter than a first length, a control unit of the image printing apparatus controls the print head and the conveyance unit such that at least one scan of the print head for printing the image is performed after a trailing edge of the print medium in the conveyance direction passes by the conveyance member disposed upstream of the print head.

19 Claims, 11 Drawing Sheets

(56) References Cited

U.S. PATENT DOCUMENTS

| | | | | |
|---|---|---|---|---|
| 9,944,096 | B2 | 4/2018 | Kudo | |
| 10,048,613 | B2 | 8/2018 | Shoji | |
| 2006/0268061 | A1 | 11/2006 | Jeong et al. | |
| 2009/0122096 | A1 | 5/2009 | Fujita | |
| 2009/0127776 | A1 | 5/2009 | Dohki | |
| 2013/0222446 | A1 | 8/2013 | Donahue et al. | |
| 2016/0202628 | A1 | 7/2016 | Shoji | |
| 2017/0100946 | A1 | 4/2017 | Kudo | |
| 2017/0151779 | A1* | 6/2017 | Yoshida | B41J 2/04581 |
| 2017/0259571 | A1* | 9/2017 | Miyakoshi | B41J 2/165 |

FOREIGN PATENT DOCUMENTS

| | | | |
|---|---|---|---|
| JP | 2016-179558 | A | 10/2016 |
| JP | 2017-071194 | A | 4/2017 |

OTHER PUBLICATIONS

Aug. 21, 2020 Chinese Official Action in Chinese Patent Appln. No. 201910099241.9.

* cited by examiner

IMAGE PRINTING APPARATUS AND CONTROL METHOD THEREFOR

This application is a division of application Ser. No. 16/257,663 filed Jan. 25, 2019.

BACKGROUND OF THE INVENTION

Field of the Invention

The present invention relates to image printing apparatuses and control methods therefor.

Description of the Related Art

There are printing apparatuses that print images on various print media including paper, cloth, and plastic sheets with the print head, based on image data outputted from office appliances, such as personal computers.

Japanese Patent Laid-Open No. 2017-71194 (hereinafter referred to as document 1) discloses a printing apparatus including a sensor provided on a carriage that moves the print head in a direction orthogonal to the conveyance direction of the print medium, the sensor configured to detect the position of the leading edge of the print medium. The printing apparatus in document 1 also has a sensor disposed upstream of the conveyance roller pair for detecting the trailing edge of the print medium. Then, the printing apparatus measures the conveyance amount from the position at which the leading edge of the print medium is detected to the position at which the trailing edge is detected. Based on the distance between the sensor on the carriage and the sensor disposed upstream of the conveyance roller pair and the conveyance amount from the position at which the leading edge of the print medium is detected to the position at which the trailing edge is detected, the length of the print medium, which is a cut sheet, in the conveyance direction is detected.

Although in document 1, the length of the print medium in the conveyance direction is detected, sometimes an image omission or a white streak occurs on the printed image depending on the length of the image or the margin lengths.

SUMMARY OF THE INVENTION

An image printing apparatus according to an aspect of the present invention includes: a print head configured to scan in a scan direction multiple times to print an image on a print medium; a conveyance unit configured to convey the print medium in a conveyance direction intersecting the scan direction; and a control unit configured to control the print head and the conveyance unit, based on image data on the image including trailing edge margin information indicating a trailing edge margin length in the conveyance direction. The conveyance unit includes a conveyance member configured to nip and convey the print medium and disposed upstream of the print head in the conveyance direction but does not include a conveyance member configured to nip and convey the print medium and disposed downstream of the print head in the conveyance direction. In a case where a trailing edge margin length indicated by the trailing edge margin information is shorter than a first length, the control unit controls the print head and the conveyance unit such that at least one scan of the print head for printing the image is performed after a trailing edge of the print medium in the conveyance direction passes by the conveyance member disposed upstream of the print head.

Further features of the present invention will become apparent from the following description of exemplary embodiments with reference to the attached drawings.

DESCRIPTION OF THE EMBODIMENTS

Hereinafter, embodiments of the present invention will be described with reference to the drawings. Note that the following embodiments are not intended to limit the present invention, and all the features described in the embodiments do not necessarily need to be combined for the solution of the present invention. Note that the same constituents are denoted by the same reference signs.

Embodiment 1

<Configuration of Image Printing Apparatus>

Figure 1:
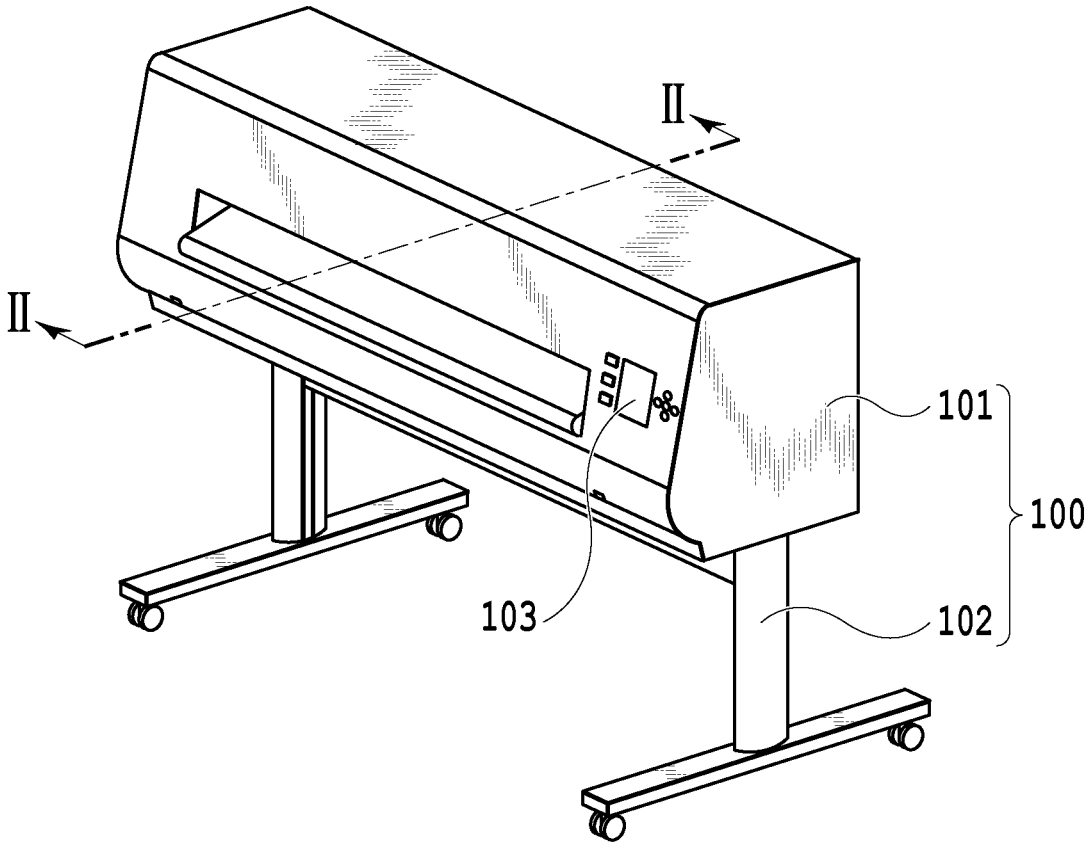
FIG. 1 is a schematic perspective view of a printing apparatus.

FIG. 1 is a schematic perspective view of an image printing apparatus 100 (hereinafter simply called a printing apparatus). The printing apparatus 100 in this embodiment is an image printing apparatus of an inkjet printing type which prints an image on a print medium by ejecting ink droplets from ejecting ports disposed in the print head 3. The printing apparatus 100 is capable of printing images on both cut paper (cut sheets) and continuous paper (continuous sheet) such as roll paper, as the print medium. The printing apparatus 100 includes a main body 101 and a leg portion 102 for supporting the main body 101. On the external portion of the main body 101 is disposed an operation panel 103 for displaying various pieces of print information, setting results, and other information and for setting the information on the print medium, the print mode, and the like.

Figure 2:
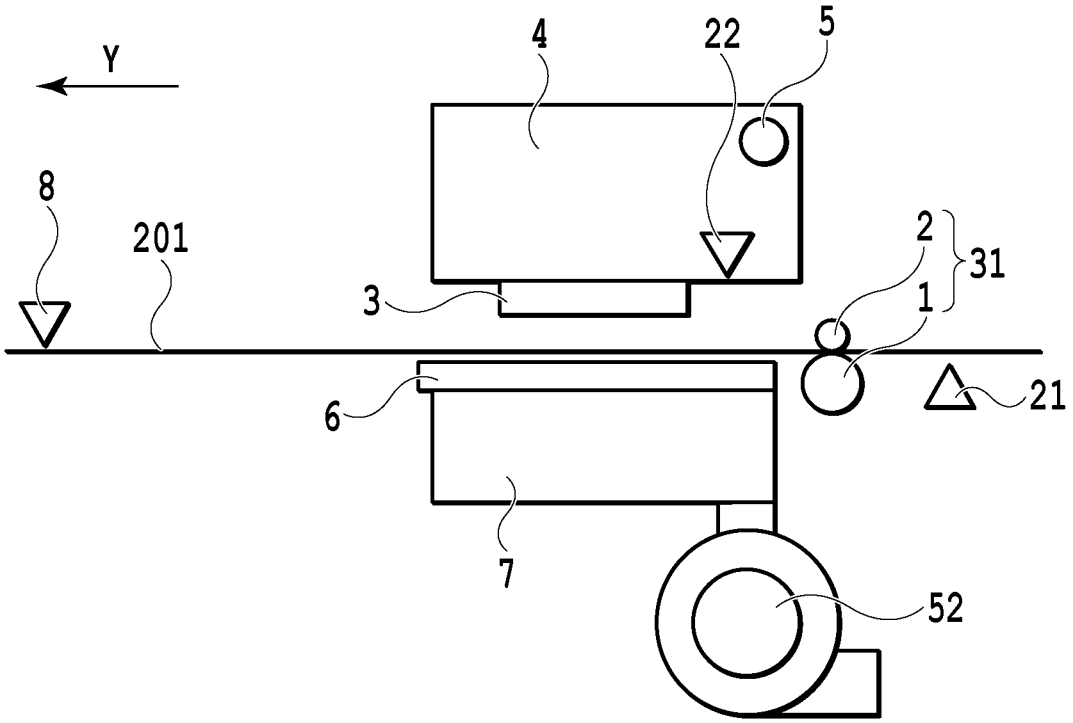
FIG. 2 is a schematic cross-sectional view of the printing apparatus.

FIG. 2 is a schematic cross-sectional view of the printing apparatus 100 illustrated in FIG. 1, taken along line II-II. A conveyance roller 1 and a driven roller 2 make up an upstream conveyance roller pair 31 disposed upstream of the printing unit in the conveyance direction Y (hereinafter also simply called a conveyance roller pair), as a conveyance unit that nips a print medium 201 and conveys it. The conveyance roller pair 31 conveys the print medium 201 by the conveyance roller 1 being driven to rotate by a conveyance motor 51 illustrated in FIG. 3. A first sensor 21 is disposed upstream in the conveyance direction Y of the conveyance roller pair 31 made up of the conveyance roller 1 and driven roller 2. The first sensor 21 has a light emitting element and a light receiving element and is capable of determining whether a print medium 201 exists in the conveyance path by emitting light from the light emitting element and receiving the reflected light with the light receiving element.

The print head 3 has multiple ejecting ports for ejecting ink disposed along the conveyance direction Y. A carriage 4, on which the print head 3 and a second sensor 22 are mounted, is supported and guided to be capable of reciprocating along a carriage shaft 5 as the scanning guide in a direction perpendicular to the page. The second sensor 22, on which various LEDs are mounted, is capable of detecting whether a print medium 201 exists, how thick it is, and the like by making the light emitting element emit light to the print medium 201 from above and receiving the reflected light. This makes it possible to detect the end positions of print media 201 of various kinds including those the materials of which are not paper, such as transparent films.

A platen 6, disposed at a position facing the print head 3, supports and guides the print medium 201 from the back surface (second surface) and ensures a gap between the print head 3 and the print medium 201. On the platen 6 is an image printing area, which is an area for printing an image. The platen 6 has multiple suction holes which are connected to a suction fan 52 via a duct 7. Driving the suction fan 52 causes negative suction pressure in the suction holes of the platen 6, and this negative suction pressure generates holding force for sucking the back surface of the print medium 201 on which an image is being printed and holding the print medium 201 on the platen 6. A cutter 8, disposed downstream of the image printing area in the conveyance direction Y, cuts the print medium 201 into predetermined lengths in a case where roll-shaped roll paper is used as the print medium 201.

When the leading edge of the print medium 201 is nipped between the conveyance roller 1 and the driven roller 2, the printing apparatus 100 drives the conveyance motor 51 to rotate. With this operation, the leading edge of the print medium 201 is conveyed onto the platen 6 by a predetermined length. After the print head 3 prints an image, corresponding to one line, in the image printing area on the platen 6 while the carriage 4 is moving, the printing apparatus 100 conveys the print medium 201 again with the conveyance roller 1 and the driven roller 2 in the conveyance direction by a predetermined length. Then, the printing apparatus 100 makes the carriage 4 move again to print an image of the next line. These operations are repeated until an image is printed on the entire page. In other words, the print head 3 scans in a scan direction multiple times to print an image on the print medium 201.

Note that the printing apparatus 100 in this embodiment does not include a discharge roller pair (conveyance member) downstream of the printing unit in the conveyance direction Y. Having a discharge roller pair would make it possible to perform print operation even after the trailing edge of the print medium 201 leaves the conveyance roller pair 31, and an image can be printed up to the vicinity of the trailing edge of the print medium, in other words, with a less margin length. However, a driven roller or spur of the discharge roller pair would come into direct contact with the surface on which an image has been printed, which may decrease the quality of the printed image. For this reason, the printing apparatus 100 in this embodiment does not include a member for nipping and conveying a print medium 201, such as a discharge roller pair, between the printing unit and the discharge opening. Note that after printing an image is finished, the print medium 201 comes off the nipping of the conveyance roller pair 31 and is released from the suction force by the platen 6, and then the print medium 201 is discharged by its own weight from the discharge opening and held on a stack unit (not illustrated) such as a basket.

<Block Diagram>

Figure 3:
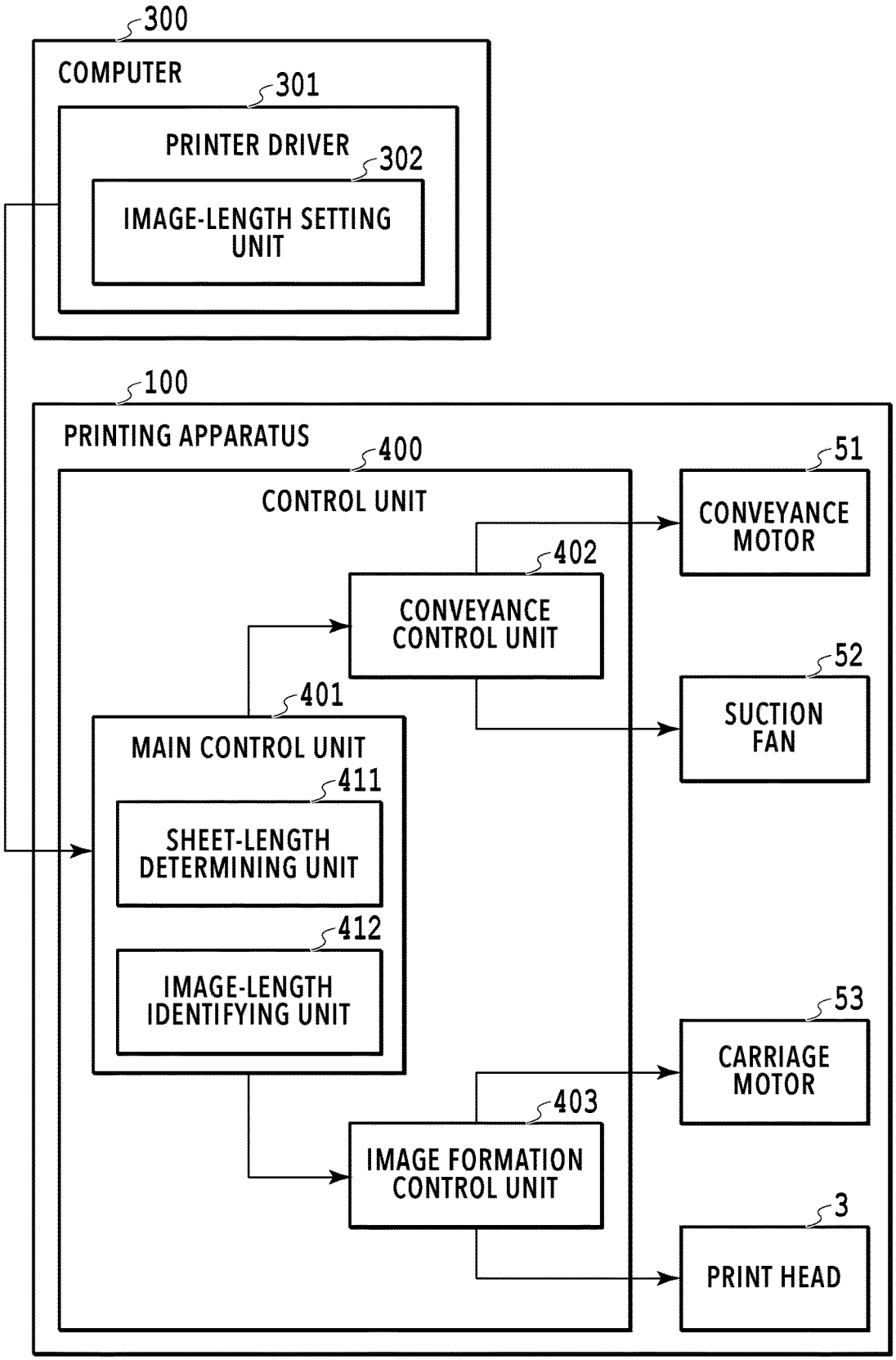
FIG. 3 is a brief block diagram of the control configuration.

FIG. 3 is a brief block diagram illustrating an embodiment of the control configuration of an image printing system. With reference to FIG. 3, the outline of the control configuration of the image printing system including the printing apparatus will be described.

The image printing system includes a computer 300 and the printing apparatus 100. In FIG. 3, the computer 300 has a printer driver 301. In this embodiment, the printer driver 301 includes an image-length setting unit 302. The image-length setting unit 302 is for letting the user set the length of an image to be printed (image length 501 illustrated in FIG. 8A, details of which will be described later).

The printing apparatus 100 has a control unit 400. The control unit 400 is for controlling the conveyance motor 51, suction fan 52, carriage motor 53, and print head 3. The control unit 400, including a CPU, a ROM, a RAM, motor drivers, and the like which are not illustrated, has a main control unit 401, conveyance control unit 402, and image formation control unit 403. The main control unit 401 includes a sheet-length determining unit 411 and an image-length identifying unit 412. The main control unit 401 gives instructions to the conveyance control unit 402 and the image formation control unit 403 according to the image length setting value set with the image-length setting unit 302 of the printer driver 301.

The sheet-length determining unit 411 is for determining sheet length L of a sheet set in the printing apparatus 100. How to determine sheet length L will be described later. The image-length identifying unit 412 is for determining image length 501 from the setting value set with the image-length setting unit 302 and received from the printer driver 301. Specifically, the image-length identifying unit 412 refers to image data (information) included in the print job to identify image length 501. The main control unit 401 outputs instructions to the conveyance control unit 402 and the image formation control unit 403 based on information on the sheet length determined by the sheet-length determining unit 411 and the image length identified by the image-length identifying unit 412. According to the instructions from the main control unit 401, the conveyance control unit 402 drives the conveyance motor 51 to convey the print medium 201. The image formation control unit 403 makes the carriage motor 53 and the print head 3 work cooperatively according to instructions from the main control unit 401 to form an image at an appropriate position.

<Conveyance Control and Sheet Length Detection>

Figure 4:
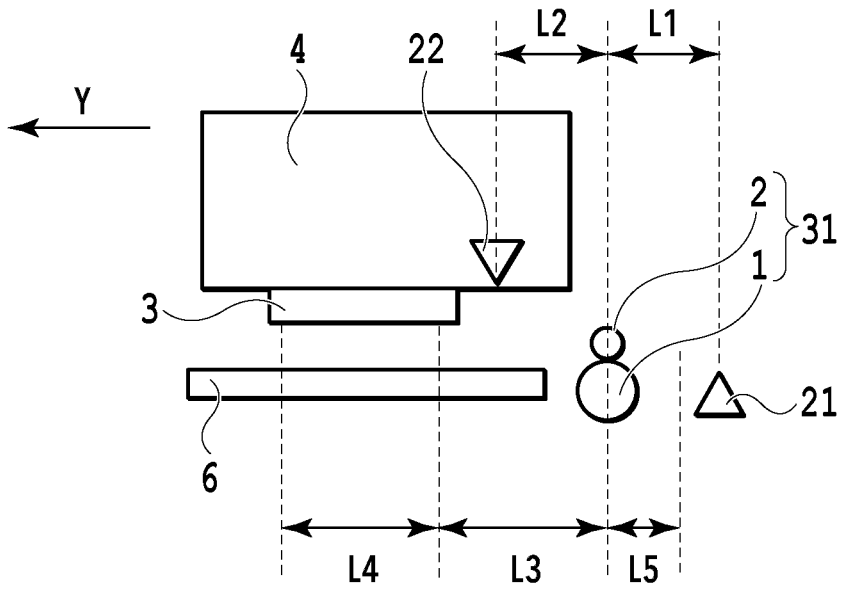
FIG. 4 is a diagram illustrating the arrangement of the constituents in the conveyance direction.

Next, with reference to FIGS. 4 to 6B, a conveyance control method and a sheet length detection method in a case where a cut sheet is fed will be described. FIG. 4 is a diagram illustrating the arrangement in the conveyance direction. FIGS. 5A and 5B and FIGS. 6A and 6B are schematic cross-sectional diagrams illustrating examples of states where a cut sheet is fed.

In FIG. 4, distance L1 is a distance between the first sensor 21 and the nipping point (nipping portion) of the conveyance roller pair 31. Distance L2 is a distance between the nipping point of the conveyance roller pair 31 and the second sensor 22. Distance L3 is a distance between the nipping point of the conveyance roller pair 31 and the most upstream ejecting ports of the print head 3. Distance L4 is the printable width of the print head 3 in the conveyance direction Y (the distance from the most upstream ejecting ports to the most downstream ejecting ports). Distance L5 is a distance between the nipping point of the conveyance roller pair 31 and the position of the trailing edge of the print medium 201 which is at the position up to which image printing can be performed by the print head 3 in the state where the print medium 201 is nipped by the conveyance roller pair 31. Note that FIG. 4 is a schematic diagram for explanation, and the scale sizes of the distances are not necessarily those shown in the diagram.

Figure 5A:
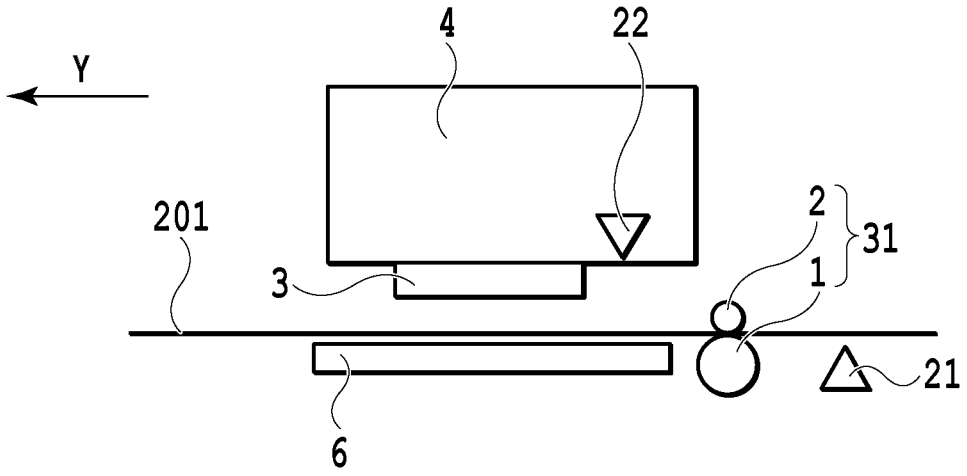
FIGS. 5A and 5B are schematic cross-sectional diagrams illustrating examples of states where a cut sheet is fed.

FIG. 5A illustrates a state where the print medium 201 which is a cut sheet is set in the printing apparatus 100. To set the print medium 201, a separation mechanism (not illustrated) for the driven roller 2 releases the nipping by the conveyance roller 1 and the driven roller 2, between which the print medium 201 is inserted. Then, when the separation mechanism (not illustrated) for the driven roller 2 is set back, the print medium 201 is nipped by the conveyance roller 1 and the driven roller 2. Note that as a method for the conveyance roller 1 and driven roller 2 nipping the print medium 201, the leading edge or trailing edge of the print medium 201 may be inserted into the nipping portion while the conveyance motor 51 is rotating in the direction that allows the print medium 201 to be pinched.

Figure 5B:
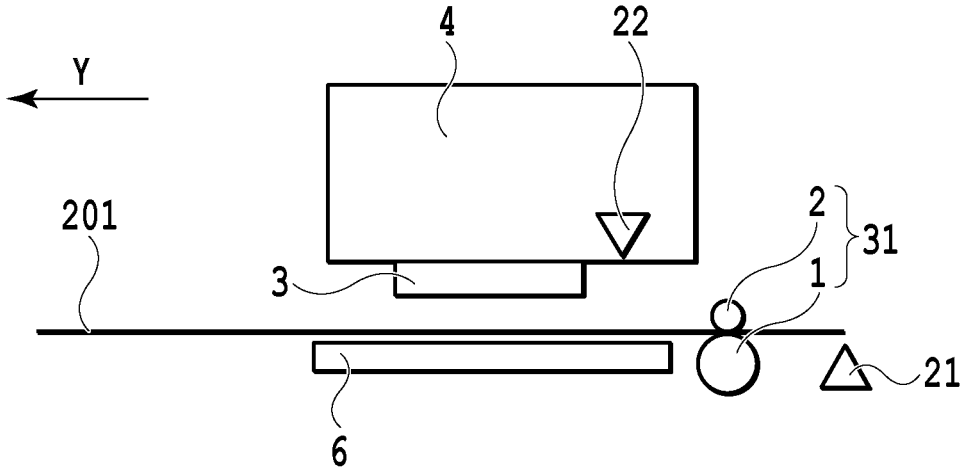

Then, the conveyance motor 51 is driven to rotate, which conveys the print medium 201 in the conveyance direction Y. When the trailing edge of the print medium 201 is conveyed to the position of the first sensor 21, the determination result of detecting the print medium 201 by the first sensor 21 changes from presence to absence. Receiving this determination result, the conveyance control unit 402 stops driving the conveyance motor 51. FIG. 5B illustrates a state where the determination result of detecting the print medium 201 by the first sensor 21 has changed from presence to absence, and thus, the position of the trailing edge of the print medium 201 is detected. Then, the conveyance control unit 402 drives the conveyance motor 51 to rotate such that the conveyance roller 1 rotates in the reverse direction. With this operation, the print medium 201 is conveyed in the opposite direction to the conveyance direction Y. When the leading edge of the print medium 201 is conveyed to the position of the second sensor 22, the determination result detecting the print medium 201 by the second sensor 22 changes from presence to absence. Receiving this determination result, the conveyance control unit 402 stop driving the conveyance motor.

Figure 6A:
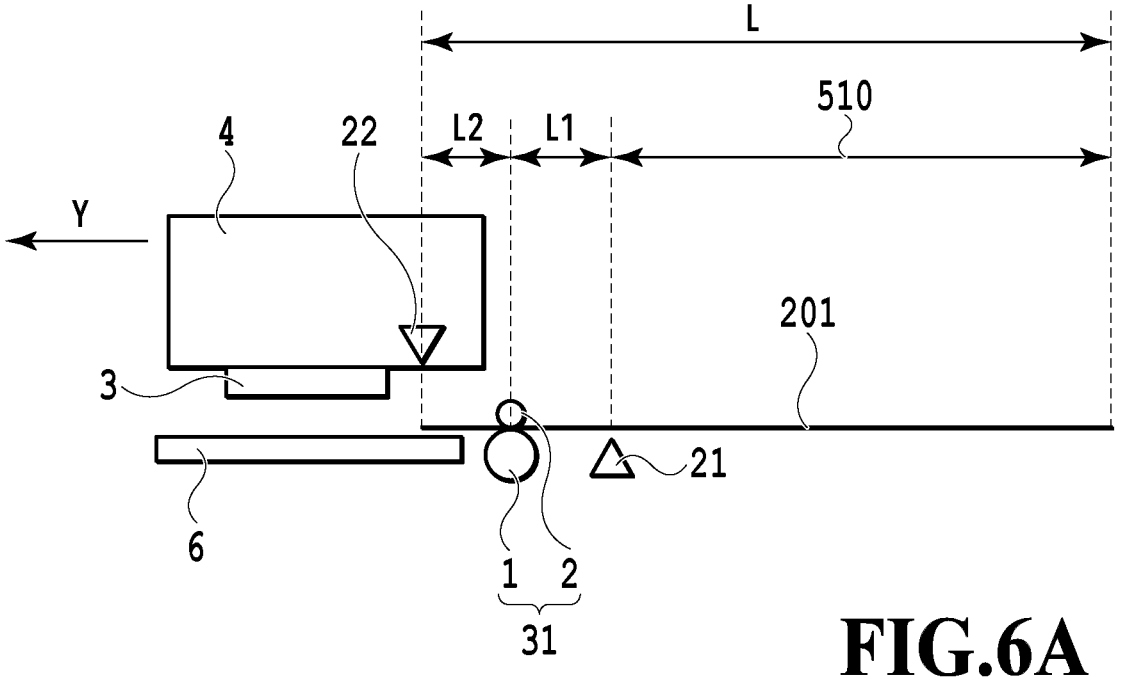
FIGS. 6A and 6B are schematic cross-sectional diagrams illustrating examples of states where a cut sheet is fed.
Figure 6B:
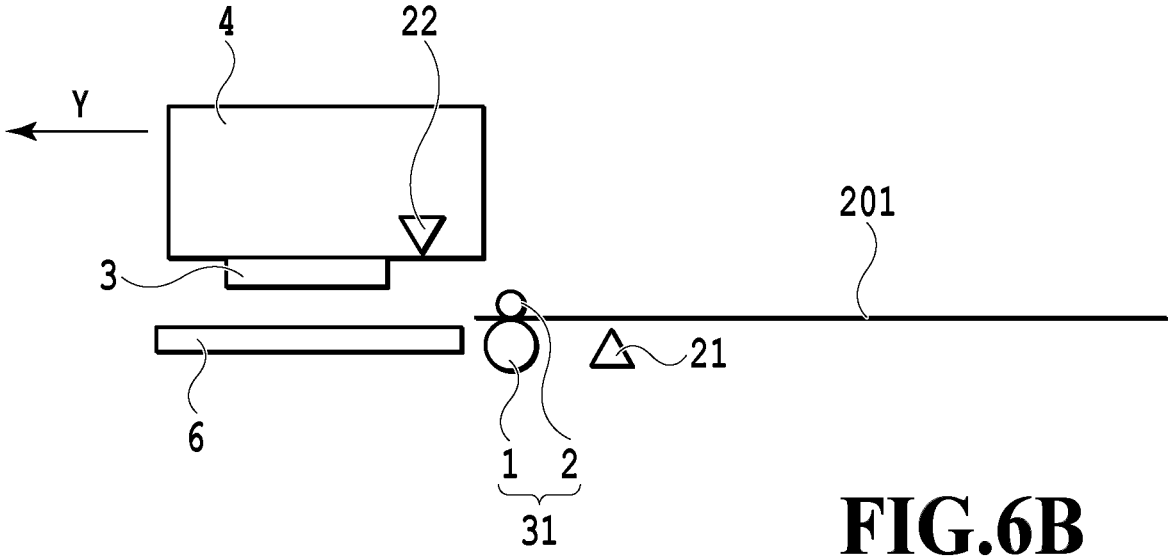

FIG. 6A illustrates a state where the determination result of detecting the print medium 201 by the second sensor 22 has changed from presence to absence, and thus, the position of the leading edge of the print medium 201 is detected. Here, the conveyance amount (conveyance distance) from the position of the print medium 201 illustrated in FIG. 5B where the first sensor 21 detects the trailing edge of the print medium 201 to the position of the print medium 201 illustrated in FIG. 6A where the second sensor 22 detects the leading edge of the print medium 201 is defined as conveyance amount 510 as illustrated in FIG. 6A. Here, as illustrated in FIG. 6A, sheet length L of the print medium 201 can be detected as conveyance amount 510+distance L1+distance L2 (see also FIG. 4). The conveyance control unit 402 conveys the leading edge of the print medium 201 from the state in FIG. 6A continuously to the vicinity of the nipping point of the conveyance roller pair 31 and waits in the state where the print medium is at a position illustrated in FIG. 6B.

<Conveyance Control during Image Printing>

Here, image omission in a printed image will be described which is a problem to be addressed in this embodiment. For example, in a case of printing an image on an A2 size (420 mm×594 mm) cut sheet, the leading edge margin, the image length, and the trailing edge margin are allocated in order on the print medium in the conveyance direction. The leading edge margin and the trailing edge margin are set in advance by the printing apparatus, the printer driver, or the like (for example, 3 mm each). Thus, in a case of a setting of conveying the cut sheet in the conveyance direction by 594 mm, the printable image length is 588 mm (the length of the print medium in the conveyance direction (594 mm)—the leading edge margin (3 mm)—the trailing edge margin (3 mm)). In a case where an image with an image length of its maximum size is needed to be printed on this cut sheet, a job with an image length of 588 mm is sent from the printer driver or the like. Here, the length, in the conveyance direction, of the cut sheet to be set in the printing apparatus sometimes varies depending on the cutting tolerance, the environment (temperature and humidity), and other factors. The larger the size of the cut sheet, the larger variation it has. For example, assume that an A2 size cut sheet is shrunk to 590 mm in length in the conveyance direction. If a job with an image length of 588 mm corresponding to the A2 size cut sheet is sent, the sheet is conveyed by the length corresponding to the starting-position setting that allocates the leading edge margin (3 mm), printing the image is started at a position 3 mm from the leading edge. In this case, to print the entire area of the image originally having a length of 588 mm, even if the trailing edge margin is set to 0 mm, the length of the cut sheet is shorter than necessary by 1 mm. As a result, an image omission from the image desired by the user occurs.

Figure 7A:
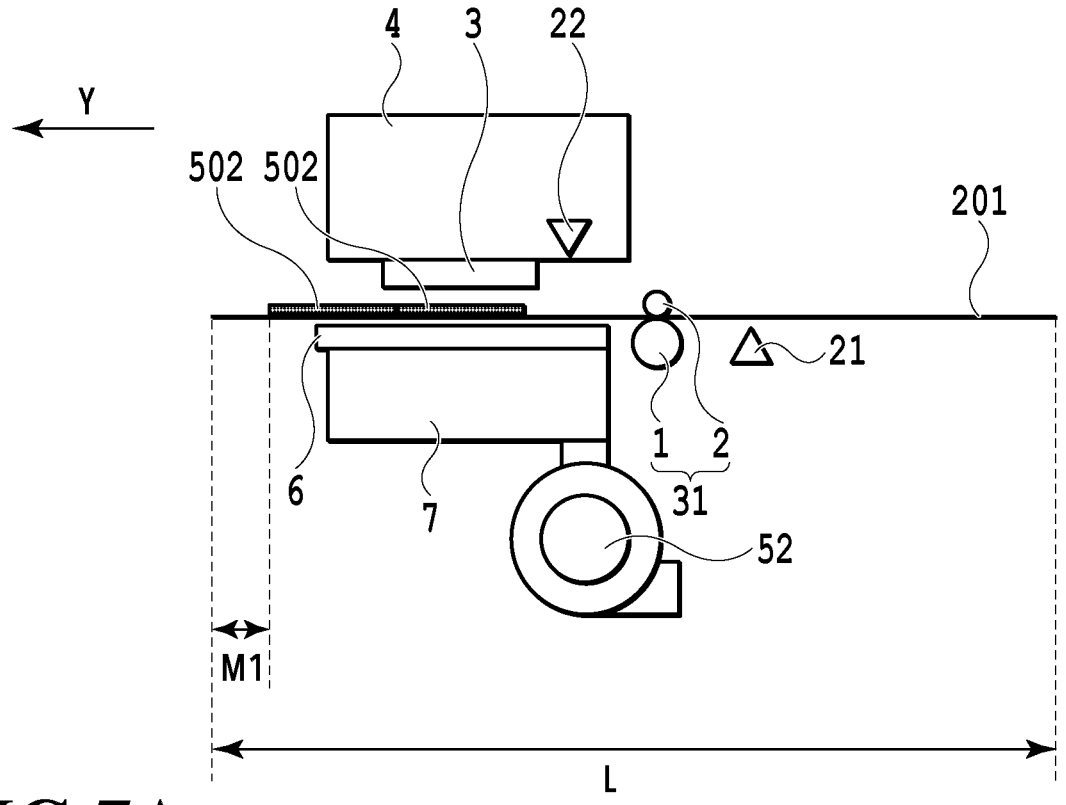
FIGS. 7A and 7B are schematic cross-sectional diagrams illustrating examples of states where an image is being printed on a cut sheet.
Figure 7B:
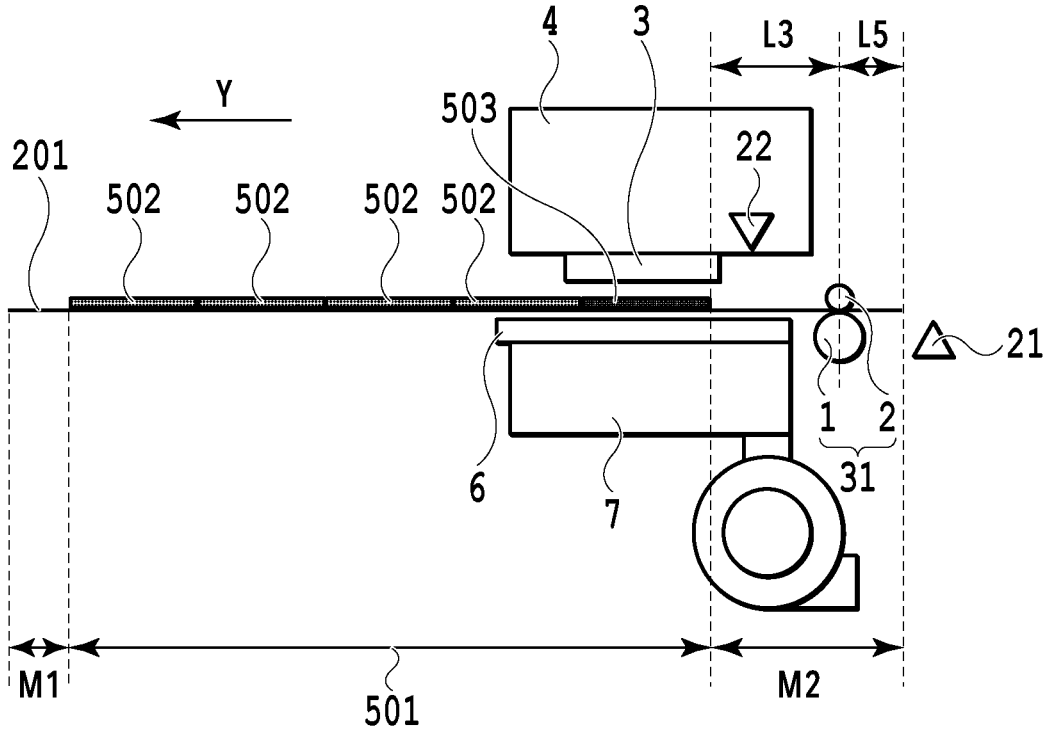
Figure 8A:
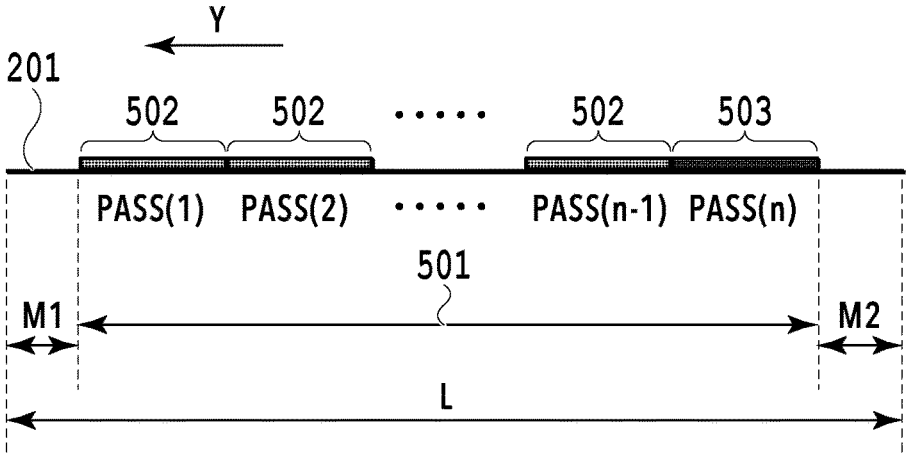
FIGS. 8A to 8C are explanatory diagrams illustrating states of images printed on print media.
Figure 8B:
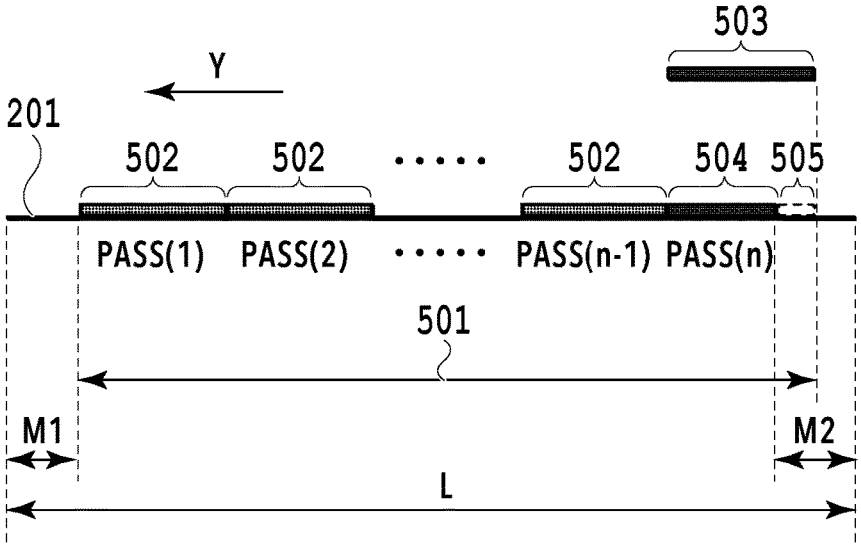
Figure 8C:
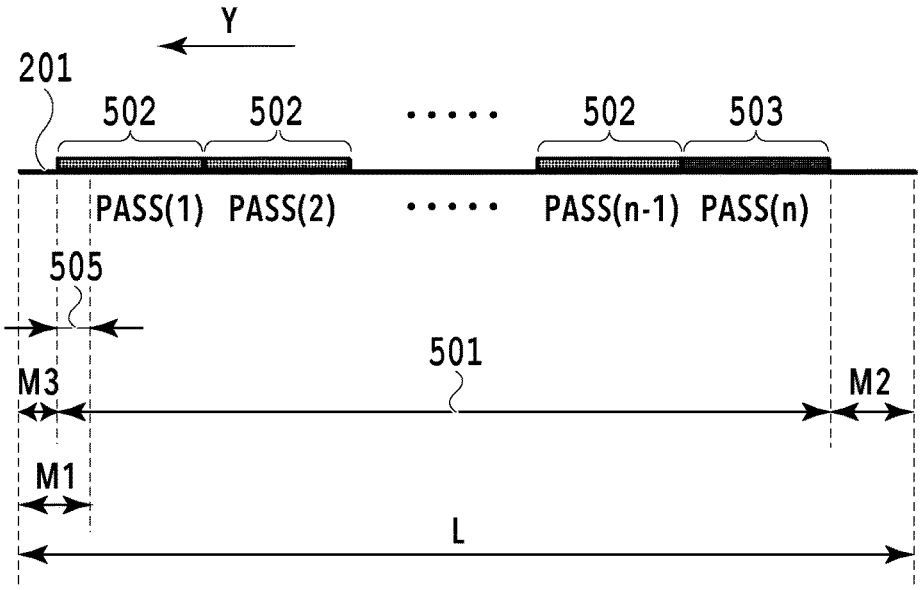

To address this problem in this embodiment, conveyance control is performed for preventing image omission from occurring in cut sheet printing. With reference to FIGS. 4 to 8C, a conveyance control method in printing an image on a cut sheet will be described. FIGS. 7A and 7B are schematic cross-sectional diagrams illustrating examples of states where an image is being printed on a cut sheet. FIGS. 8A to 8C are explanatory diagrams illustrating states of images printed on print media.

FIG. 7A illustrates a state where an image is being printed on the print medium 201. From the standby position of the print medium 201 illustrated in FIG. 6B, the conveyance control unit 402 drives the conveyance motor 51 to rotate to conveys the print medium 201 in the conveyance direction Y. Here, the conveyance control unit 402 conveys the print medium 201 in the conveyance direction Y by the conveyance amount in which leading edge margin length M1, the positions of the ejecting ports of the print head 3 to be used, and print length 502 of pass (1) are taken into account. Then, under the control of the image formation control unit 403, an image corresponding to print length 502 of one-line pass (1) by the print head 3 is printed on the print medium 201. Here, the "pass" means a print operation along with the one-line movement of the carriage 4 in the forward or backward direction. Pass (1) means the first print operation (print operation of the first pass).

After that, the conveyance control unit 402 drives the conveyance motor 51 to rotate to convey the print medium 201 in the conveyance direction Y by print length 502 of pass (2), and under the control of the image formation control unit 403, an image corresponding to print length 502 of pass (2) is printed on the print medium 201. These operations are repeated until the pass number reaches pass (n−1). Here, pass (n) is image printing on the print medium 201 by the last pass.

FIG. 7B illustrates a state where an image corresponding to the last pass (n) is being printed on the print medium 201. FIG. 7B illustrates an example in which an image omission does not occur. Specifically, FIG. 7B illustrates a state where an image corresponding to the last pass (n) is being printed on the print medium 201 in a case where sheet length L of the print medium 201 is equal to the total length of leading edge margin length M1, image length 501, and trailing edge margin length M2 included in the print job.

In the conveyance before image printing of the last pass (n), the first sensor 21 may detect the trailing edge of the print medium 201 depending on sheet length L of the print medium 201. To print an image corresponding to the last pass (n) with the print medium 201 nipped by the conveyance roller pair 31 of the conveyance roller 1 and the driven roller 2, the conveyance control has to be performed such that the trailing edge of the print medium 201 does not pass through the nipping point of the conveyance roller pair 31. With this taken into account in this embodiment, in a case where the first sensor 21 detects the trailing edge of the print medium 201, the conveyance control unit 402 performs the conveyance control on the print medium 201, setting a conveyance limit at the position at which the trailing edge of the print medium 201 is positioned distance L5 upstream from the nipping point of the conveyance roller pair 31. In FIG. 7B, the trailing edge of the print medium 201 is positioned at the conveyance limit point which is distance L5 upstream from the nipping point of the conveyance roller pair 31. In this state, ejecting ports corresponding to print length 503 from the most upstream ejecting ports of the print head 3 are used for image printing, and this makes it possible to print the entire area of image length 501. The state of an image printed in this case is illustrated in FIG. 8A. FIG. 8A illustrates the state of an image printed on the print medium 201 in a case sheet length L of the print medium 201 is equal to the total length of leading edge margin length M1, image length 501, and trailing edge margin length M2 received as a print job.

On the other hand, FIG. 8B illustrates the state of an image printed in a case sheet length L of the print medium 201 is shorter than the total length of leading edge margin length M1, image length 501, and trailing edge margin length M2 received as a print job. During conveyance corresponding to print length 503 before image printing of the last pass (n), the trailing edge of the print medium 201 is conveyed and reaches the conveyance limit point, and the conveyance is stopped at the position distance L5 upstream from the nipping point of the conveyance roller pair 31. Thus, in this state, although the conveyance corresponding to print length 503 is necessary to print the image of image length 501, only conveyance corresponding to print length 504 is allowed. Then, although the image is printed by the print head 3, even though the most upstream ejecting ports of the print head 3 is used, an image corresponding to print length 505 (print length 503—print length 504) cannot be printed. As a result, an image omission corresponding to print length 505 occurs.

The image-length setting unit 302 of the printer driver 301 sets leading edge margin information indicating a leading edge margin length, image length information indicating an image length, and trailing edge margin information indicating trailing edge margin length corresponding to a predetermined sheet length. Then, a print job including those pieces of information is sent from the printer driver 301 to the main control unit 401. In a case where the sheet length of the print medium is equal to the sheet length understood by the user (or the printer driver 301), the printed image is like the one illustrated in FIG. 8A. However, the sheet length of a print medium may vary due to the cutting tolerance, the environment (temperature and humidity), and other factors. As a result, in a case where sheet length L of a print medium is shorter than the sheet length that the user (or the printer driver 301) understands it is, the printed image is like the one illustrated in FIG. 8B, and an image omission occurs.

Note that in FIG. 8B, the length of print length 505 is equal to the difference between sheet length L of the print medium 201 and the total length of leading edge margin length M1, image length 501, and trailing edge margin length M2 included in the print job.

Thus, in this embodiment, in a case where sheet length L of the print medium 201 is shorter than the total length of leading edge margin length M1, image length 501, and trailing edge margin length M2 included in a print job received from the printer driver 301, the image is printed on the print medium 201 as illustrated in FIG. 8C. Specifically, control is performed such that the leading edge margin length is equal to leading edge margin length M3 which is shorter than leading edge margin length M1 included in the print job. In the example of FIG. 8C, the length of the difference between sheet length L of the print medium 201 and the total length of leading edge margin length M1, image length 501, and trailing edge margin length M2 included in the print job is equal to print length 505 illustrated in FIG. 8B. At the conveyance before image printing for pass (1), the conveyance control unit 402 conveys the print medium 201 such that the image-printing starting position (printing starting position) for print length 502 is the length obtained by subtracting print length 505 from leading edge margin length M1 included in the print job, from the leading edge. The leading edge margin length in this case is defined as M3. Leading edge margin length M3 is calculated as M3=M1—print length 505. In this way, the conveyance control unit 402 changes the leading edge margin length from leading edge margin length M1 included in the received print job to leading edge margin length M3. Specifically, the conveyance control unit 402 changes the image-printing starting position (the leading edge margin length) to leading edge margin length M3. As a result of changing the leading edge margin length from M1 to M3, the total length of leading edge margin length M3 after the change, image length 501, and trailing edge margin length M2 is equal to sheet length L of the print medium 201. Thus, the entire image with image length 501 included in the print job can be printed on the print medium 201.

<Flowchart>

Figure 9:
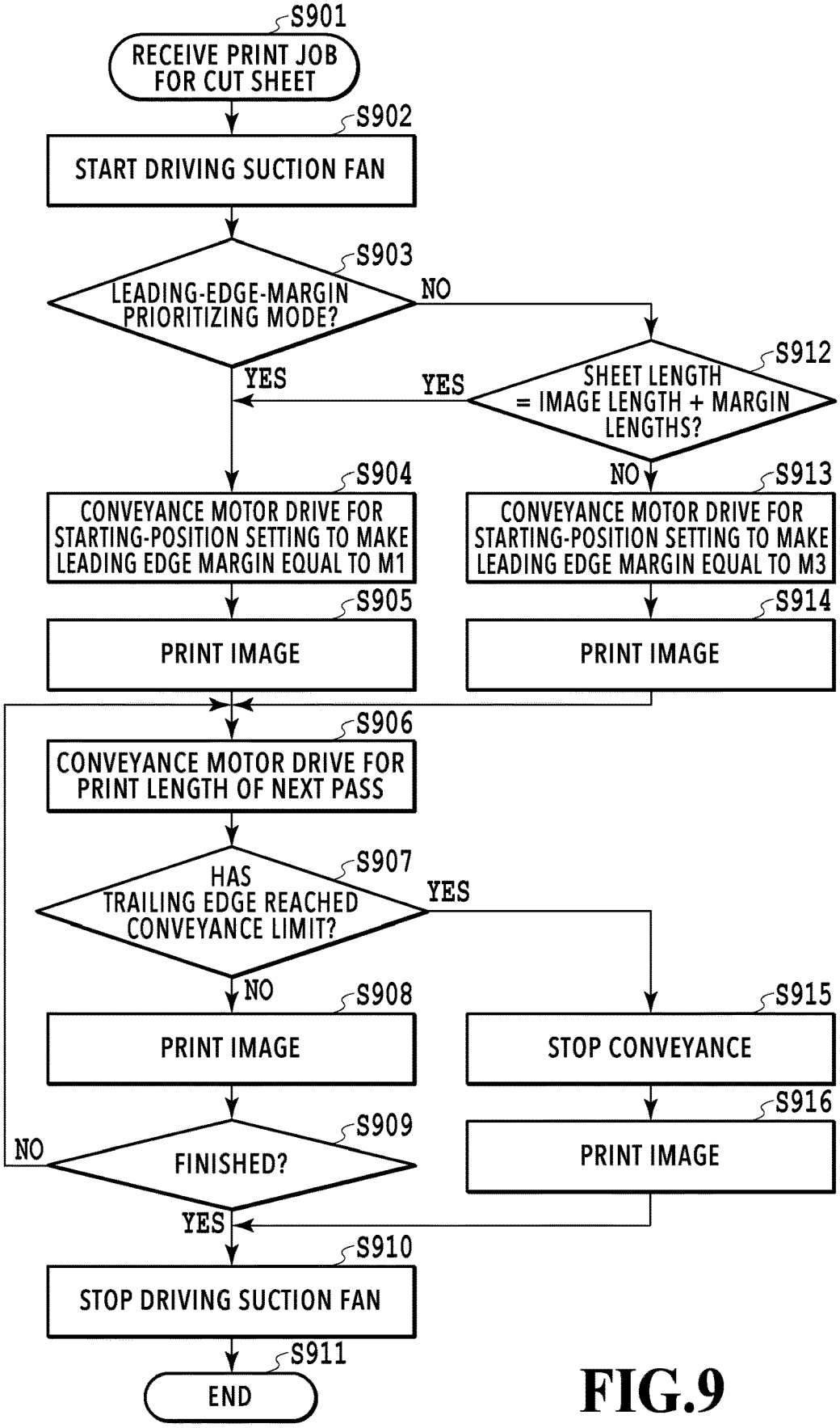
FIG. 9 is a flowchart illustrating an image printing procedure.

Next, with reference to FIG. 9, a series of operations in image printing according to this embodiment will be described. FIG. 9 is a flowchart illustrating image print processing. FIG. 9 illustrates processing in a case where the main control unit 401 receives a print job for a cut sheet from the printer driver 301. Note that it is assumed that sheet length L of the print medium 201 has been determined using the control described with reference to FIGS. 5A to 6B by the sheet-length determining unit 411 before receiving the print job for a cut sheet.

At step S901 in FIG. 9, the main control unit 401 receives a print job for a cut sheet in a state where a print medium 201 which is a cut sheet is fed and set (in other words, in a state where sheet length L of the cut sheet has been determined by the sheet-length determining unit 411). At step S902, the main control unit 401 controls the conveyance control unit 402 to start driving the suction fan 52. At step S903, the main control unit 401 checks the image print mode set by the user with the operation panel 103 or the like. The image print mode includes a leading-edge-margin prioritizing mode and an image-omission reducing mode. In the leading-edge-margin prioritizing mode, an image is printed using leading edge margin length M1 received as a print job. In the image-omission reducing mode, leading edge margin length M1 received as a print job is adjusted to leading edge margin length M3. Thus, even if sheet length L of the print medium 201 is shorter than necessary, image length 501 received as the print job is used in printing. If the image print mode is the leading-edge-margin prioritizing mode, the process proceeds to step S904, and if it is the image-omission reducing mode, the process proceeds to step S912.

In a case of the leading-edge-margin prioritizing mode, the conveyance control unit 402, at step S904, drives the conveyance motor 51 to rotate by the degree corresponding to the starting-position setting conveyance that makes the leading edge margin equal to M1. Next, at step S905, the image formation control unit 403 controls the carriage motor 53 and the print head 3 to print an image corresponding to print length 502 of pass (1) on the print medium 201. Then, at step S906, the conveyance control unit 402 drives the conveyance motor 51 to rotate by the degree corresponding to print length 502. At step S907, the conveyance control unit 402 determines whether the trailing edge of the print medium 201 has reached the conveyance limit position. If the trailing edge of the print medium 201 is not at the conveyance limit position, an image corresponding to print length 502 is printed at step S908. At step S909, the main control unit 401 determines whether printing the image has been finished, in other words, whether an image corresponding to print length 503 of the last pass (n) has been printed. If it has not been finished, the process returns to step S906, and if finished, the process proceeds to step S910. In this way, the conveyance control at step S906 and the image printing at step S908 are repeated until the trailing edge of the print medium reaches the conveyance limit position, or until an image corresponding to print length 503 of pass (n), which is the last pass, is printed. At step S910, the conveyance control unit 402 stops driving the suction fan 52. Then, the process proceeds to step S911, and the main control unit 401 enters the standby state.

Note that at step S906, while the conveyance motor 51 is being driven to rotate by the degree corresponding to the print length, if the trailing edge of the print medium 201 reaches the conveyance limit point which is distance L5 upstream from the nipping point of the conveyance roller pair 31, the process proceeds to step S915. At step S915, the conveyance control unit 402 stops driving the conveyance motor 51. In this case, the process proceeds to step S916, and the image formation control unit 403 prints only an image corresponding to the length by which the print medium 201 was conveyed. The minimum trailing edge margin length in this case is the distance (L3+L5) from the conveyance limit point to the most upstream ejecting ports of the print head 3 (see FIG. 7B).

In the case where the image print mode is the image-omission reducing mode, the main control unit 401, at step S912, compares sheet length L of the print medium 201 and the total length of leading edge margin length M1, image length 501, and trailing edge margin length M2 included in the print job. Sheet length L of the print medium 201 has been measured when the print medium 201 was fed. In a case where sheet length L is equal to the total length of leading edge margin length M1, image length 501, and trailing edge margin length M2, the process proceeds to step S904. Then, as described above, the conveyance control unit 402 drives the conveyance motor 51 to rotate by the degree corresponding to the starting-position setting conveyance that makes the leading edge margin equal to M1, and at step S905, the image formation control unit 403 prints an image corresponding to print length 502 of pass (1).

On the other hand, in a case where sheet length L is not equal to the total length of leading edge margin length M1, image length 501, and trailing edge margin length M2, the process proceeds to step S913. Then, the conveyance control unit 402 drives the conveyance motor 51 to rotate in such a way that leading edge margin length M1 is changed to leading edge margin length M3 determined by taking into account the difference between sheet length L and the total length of leading edge margin length M1, image length 501, and trailing edge margin length M2. In other words, the conveyance control unit 402 determines to make the leading edge margin length equal to M3. Then, the conveyance control unit 402 drives the conveyance motor 51 to rotate by the degree corresponding to the starting-position setting conveyance that makes the leading edge margin equal to the determined leading edge margin length M3. Then, at step S914, the image formation control unit 403 prints an image corresponding to print length 502 of pass (1). After that, the process proceeds to step S906, and the same processes as described in the leading-edge-margin prioritizing mode are performed.

At step S913, to be more specific, in a case where sheet length L is shorter than the total length of leading edge margin length M1, image length 501, and trailing edge margin length M2, the conveyance motor 51 is driven to rotate in such a way that the leading edge margin length is equal to M3 which is shorter than leading edge margin length M1 by the difference. On the other hand, in a case where sheet length L is longer than the total length of leading edge margin length M1, image length 501, and trailing edge margin length M2, the conveyance motor 51 is driven to rotate in such a way that the leading edge margin length is equal to M3 which is longer than leading edge margin length M1 by the difference.

As described above in this embodiment, in the image-omission reducing mode, the leading edge margin length is adjusted so that the total length of image length 501 and trailing edge margin length M2 can be allocated in the distance from the position of the trailing edge of the print medium 201 to the image-printing starting position (printing starting position) (see FIGS. 7A to 8C).

Note that although description has been provided for an example in which in a case where sheet length L is longer than the total length of leading edge margin length M1, image length 501, and trailing edge margin length M2, the conveyance motor 51 is driven to rotate in such a way that the leading edge margin length is equal to M3 which is longer than leading edge margin length M1 by the difference, the present invention is not limited to this example. In a case where sheet length L is longer than the total length of leading edge margin length M1, image length 501, and trailing edge margin length M2, since an image omission as illustrated in FIG. 8B will not occur, the leading edge margin length may be leading edge margin length M1 included in the print job instead of the leading edge margin length M3 after the adjustment.

In addition, although description has been provided as an example for the case where sheet length L is determined by the sheet-length determining unit 411 at the time when a cut sheet is fed, which is before receiving a print job for the cut sheet, the present invention is not limited to this case. For example, sheet length L may be determined, in a case where the print mode is determined to be the image-omission reducing mode at step S903, before the determination at step S912.

As described above, in this embodiment, the total length of leading edge margin length M1, image length 501, and trailing edge margin length M2 received as a print job is compared with sheet length L of the print medium 201. If sheet length L is determined to be shorter, the length of the starting-position setting conveyance to the printing starting position is adjusted to make the leading edge margin length short accordingly. This reduces the possibility of an image omission of an image with image length 501 even in a case where sheet length L is short. Thus, the printing apparatus in this embodiment makes it possible to reduce the possibility of an image omission even in a case where the sheet length of the print medium in the conveyance direction varies.

Note that in this embodiment, the print head has an ejecting port array (nozzle array) in which multiple ejecting ports (nozzles) for ejecting ink are arrayed in a first direction, and print operation is performed by printing an image on a print medium while the print head is being moved in a second direction intersecting the first direction relative to the print medium. In the conveyance operation, the print medium is conveyed in the first direction. These print operation and conveyance operation are repeated alternately. As above, description has been provided for a configuration for printing an image on a print medium with these operations (serial type printing apparatus). However, the present invention is not limited to this example. The present invention is also applicable to a configuration for printing an image on a print medium by conveying the print medium in the first direction relative to the print head having an ejecting port array in which multiple ejecting ports for ejecting ink are arranged in the second direction by the distance corresponding to the width of the print medium (line type printing apparatus).

Embodiment 2

In the configuration of embodiment 1 described above, the conveyance limit is set at the position at which the trailing edge of the print medium 201 is positioned distance L5 upstream from the nipping point of the conveyance roller pair 31, and an image of the last pass is printed in the state the print medium 201 is nipped by the conveyance roller pair 31. In this embodiment, description will be provided for a configuration in which the print medium 201 is conveyed beyond this conveyance limit, and an image of the last pass is printed in the state where the print medium 201 is not nipped by the conveyance roller pair 31. In other words, description will be provided for a configuration in which at least one scan of the print head is performed after a trailing edge of the print medium in the conveyance direction passes by conveyance roller pair 31. This configuration enables an image to be printed with a trailing edge margin length shorter than the trailing edge margin length in embodiment 1. The same constituents as in embodiment 1 are denoted by the same reference signs, and description thereof is omitted.

Figure 10:
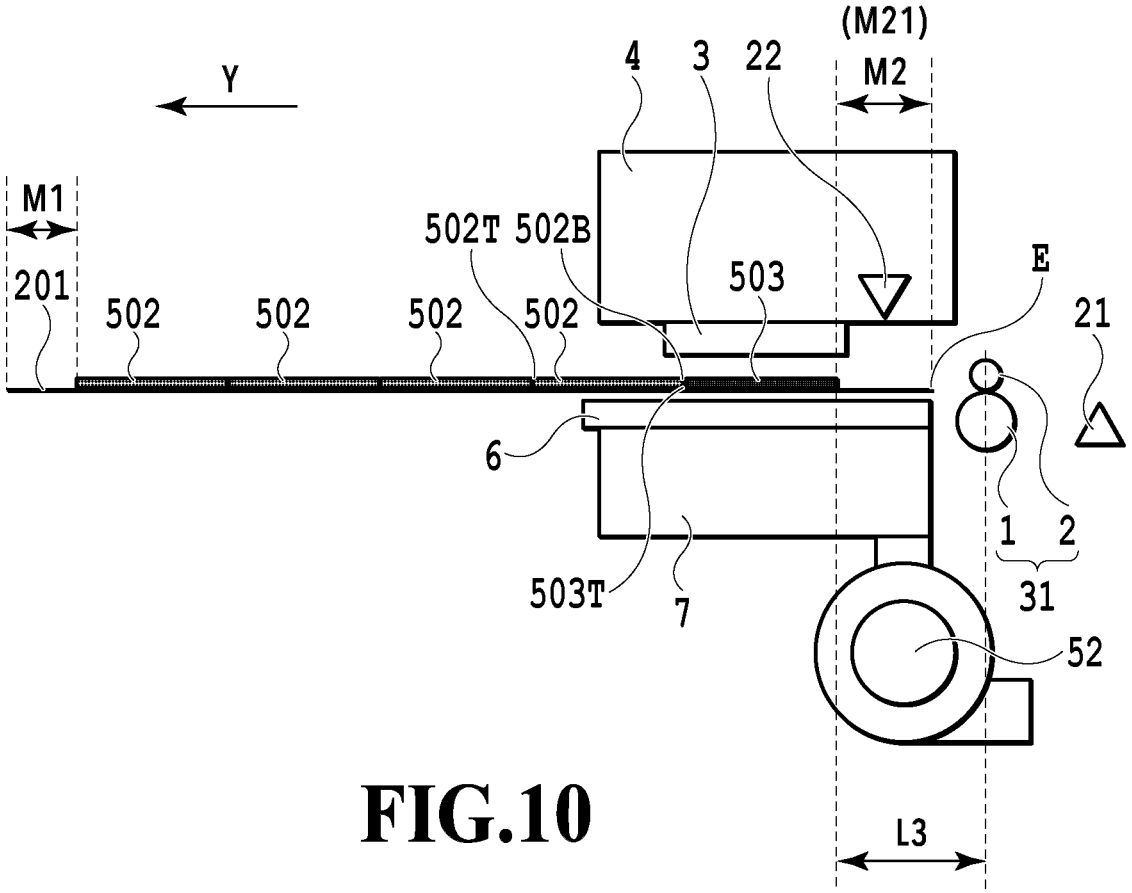
FIG. 10 is a schematic cross-sectional diagram illustrating an example of a state where an image is being printed on a cut sheet.

FIG. 10 is a schematic cross-sectional diagram illustrating an example of a state where an image is being printed on a cut sheet, in this embodiment. With reference to FIG. 10, description will be provided for a conveyance control method in printing an image on a cut sheet.

In FIG. 10, an image is printed on a print medium 201 in a state where trailing edge margin length M2 is shorter than distance L3 (the distance between the nipping point of the conveyance roller pair 31 and the most upstream ejecting ports of the print head 3). The state where trailing edge margin length M2 is shorter than distance L3 means the state where the print medium 201 is not nipped by the conveyance roller pair 31 as illustrated in FIG. 10. In other words, the print medium 201 is conveyed beyond the conveyance limit point described in embodiment 1 (the position at which the trailing edge of the print medium 201 is distance L5 upstream from the nipping point of the conveyance roller pair 31), and an image is printed in the state where the print medium 201 is not nipped by the conveyance roller pair 31. In such a case, during the conveyance for print length 503 of the last pass (n), the print medium 201 is released from the nipping by the conveyance roller 1 and the driven roller 2.

The conveyance force in the state where the print medium 201 is released from the nipping by the conveyance roller 1 and the driven roller 2 is a combination of the frictional force between the conveyance roller 1 and the trailing edge of the print medium 201 generated by the rotation of the conveyance roller 1 and the inertial force caused when the print medium 201 is released from the nipping. Thus, the conveyance force is small and unstable. For this reason, in a case of the conveyance in the state where the print medium 201 is released from the nipping by the conveyance roller 1 and the driven roller 2, the rotational speed of the conveyance motor 51 is set larger, or the print medium holding force by the suction fan 52 is set smaller, for example. In this way, the trailing edge of the print medium 201 is conveyed to position E up to which the print medium 201 can be conveyed by the inertial force and the frictional force between the conveyance roller 1 and the trailing edge of the print medium 201. Thus, in a case where trailing edge margin length M2<distance L3 (the distance between the nipping point of the conveyance roller pair 31 and the most upstream ejecting ports of the print head 3), the image printing position of the last pass (n) (print length 503) is determined by the position of the trailing edge of the print medium 201 (position E up to which conveyance is possible). In the following, for convenience of explanation, the trailing edge margin length in a case where trailing edge margin length M2 is shorter than distance L3 is referred to as trailing edge margin length M21.

Compared to the conveyance by the nipping of the conveyance roller 1 and the driven roller 2, adjustment accuracy of the conveyance amount is low in a case where the print medium 201 is released from the nipping. In other words, it is difficult to convey the trailing edge of the print medium 201 to a specific point between the nipping point of the conveyance roller pair 31 and position E up to which conveyance is possible. For example, the conveyance amount in a case where the print medium 201 is released from the nipping can be control with an accuracy of about a millimeter, but the adjustment accuracy is lower than in the conveyance by the nipping of the conveyance roller 1 and the driven roller 2.

Here, as illustrated in FIG. 10, the leading edge side print position of print length 503 of the last pass (n) on the print medium 201 is defined as leading edge side print position 503T. The distance between leading edge side print position 503T of print length 503 of the last pass (n) and the trailing edge of the print medium 201 is equal to trailing edge margin length M21+print length 503. In other words, leading edge side print position 503T of print length 503 of the last pass (n) is sheet length L—(trailing edge margin length M21+print length 503) from the leading edge of the print medium 201, which means leading edge side print position 503T is affected by sheet length L. In this way, for image printing at the trailing edge of the image in this embodiment, image printing is performed at a position based on the position of the trailing edge of the print medium 201 by the conveyance control. In other words, printing for the last pass (n) is performed based on the position of the trailing edge of the print medium 201 (position E up to which conveyance is possible).

On the other hand, image printing positions (print length 502) for pass (1) to pass (n−1) are determined according to leading edge margin length M1. In other words, an image for print length 502 of pass (1) is printed after the print medium 201 is conveyed from the leading edge of the print medium 201 by the length corresponding to the starting-position setting conveyance that makes the leading edge margin length equal to M1. After that, conveyance for print length 502 of the next pass is performed before image printing. These conveyance operation and print operation are repeated alternately. This means that image printing positions (print length 502) for pass (1) to pass (n−1) are determined according to leading edge margin length M1. Here, for example, the leading edge side print position of print length 502 of pass (n−1) on the print medium 201, which is one pass before the last pass, is defined as leading edge side print position 502T as illustrated in FIG. 10. Leading edge side print position 502T of print length 502 of pass (n−1) is leading edge margin length M1+(print length 502×pass number (n−2)) from the leading edge of the print medium 201. Here, the trailing edge side print position of print length 502 of pass (n−1) on the print medium 201, which is one pass before the last pass, is defined as trailing edge side print position 502B as illustrated in FIG. 10. Then, trailing edge side print position 502B is leading edge margin length M1+(print length 502×pass number (n−1)) from the leading edge of the print medium 201.

Here, the relationship between pass (n−1), which is one pass before the last pass, and the last pass (n) will be described. In a case where trailing edge side print position 502B of pass (n−1) does not match leading edge side print position 503T of pass (n), a streak may occur on the printed image. For example, in a case where leading edge side print position 503T of pass (n) is positioned on the leading edge side of the print medium 201 relative to trailing edge side print position 502B of pass (n−1), print length 502 of pass (n−1) and print length 503 of pass (n) are overlapped. Conversely, in a case where leading edge side print position 503T of pass (n) is positioned on the trailing edge side of the print medium 201 relative to trailing edge side print position 502B of pass (n−1), a gap occurs between print length 502 of pass (n−1) and print length 503 of pass (n). There is no printed image on the gap. As a result, in a case where the print medium 201 is white, a white streak occurs. To prevent such a streak from occurring, it is conceivable to adjust at least one of trailing edge side print position 502B of pass (n−1) and leading edge side print position 503T of pass (n).

Here, trailing edge side print position 502B of pass (n−1) is determined by leading edge margin length M1+(print length 502×pass number (n−1)) as described above. Thus, to adjust trailing edge side print position 502B of pass (n−1), leading edge margin length M1 needs to be changed. On the other hand, leading edge side print position 503T of the last pass (n) is determined by sheet length L—(trailing edge margin length M21+print length 503) as described above. Thus, to adjust leading edge side print position 503T of pass (n), trailing edge margin length M21 needs to be changed. In other words, to prevent the occurrence of a streak, leading edge margin length M1 or trailing edge margin length M21 needs to be changed. Here, as described above, changing trailing edge margin length M21 is difficult to control because the conveyance is performed in a state where the print medium 201 is released from the nipping by the conveyance roller lthe driven roller 2. For this reason, in this embodiment, leading edge margin length M1 is changed to sheet length L—(trailing edge margin length M21+image length 501) for image printing. In other words, leading edge side print position 503T of the last pass (n) is not changed, but trailing edge side print position 502B of pass (n−1) is changed to adjust the positional relationship between trailing edge side print position 502B of pass (n−1) and leading edge side print position 503T of the last pass (n). This reduces the possibility of occurrence of a streak on the printed image. Note that as described earlier, "trailing edge margin length M21" in a case where leading edge margin length M1 is changed to sheet length L—(trailing edge margin length M21+image length 501) is determined by the position of the trailing edge of the print medium 201 (position E up to which conveyance is possible).

Note that as described in embodiment 1, a print job includes leading edge margin length M1, image length 501, and trailing edge margin length M2. In this embodiment, for convenience of explanation, the trailing edge margin length included in a print job is called trailing edge margin length M22. In this embodiment, the main control unit 401 determines whether trailing edge margin length M22 included in a print job is shorter than distance L3 (the distance between the nipping point of the conveyance roller pair 31 and the most upstream ejecting ports of the print head 3). If trailing edge margin length M22 is shorter than distance L3, the main control unit 401 determines to perform a release conveyance mode in which printing for the last pass is performed after a print medium 201 is released from the conveyance roller pair 31. Then, the main control unit 401 sets leading edge margin length M1 to sheet length L—(trailing edge margin length M21+image length 501). The "trailing edge margin length M21" here is not the one included in the print job but is determined by the position of the trailing edge of the print medium 201 (position E up to which conveyance is possible) as described above. Note that the present invention is not limited to the case where the print job includes a numerical value indicating the trailing edge margin length, but, for example, the print job may include information related to the position of the image to be printed or information for giving an instruction to perform the release conveyance mode.

<Explanation of Flowchart>

Figure 11:
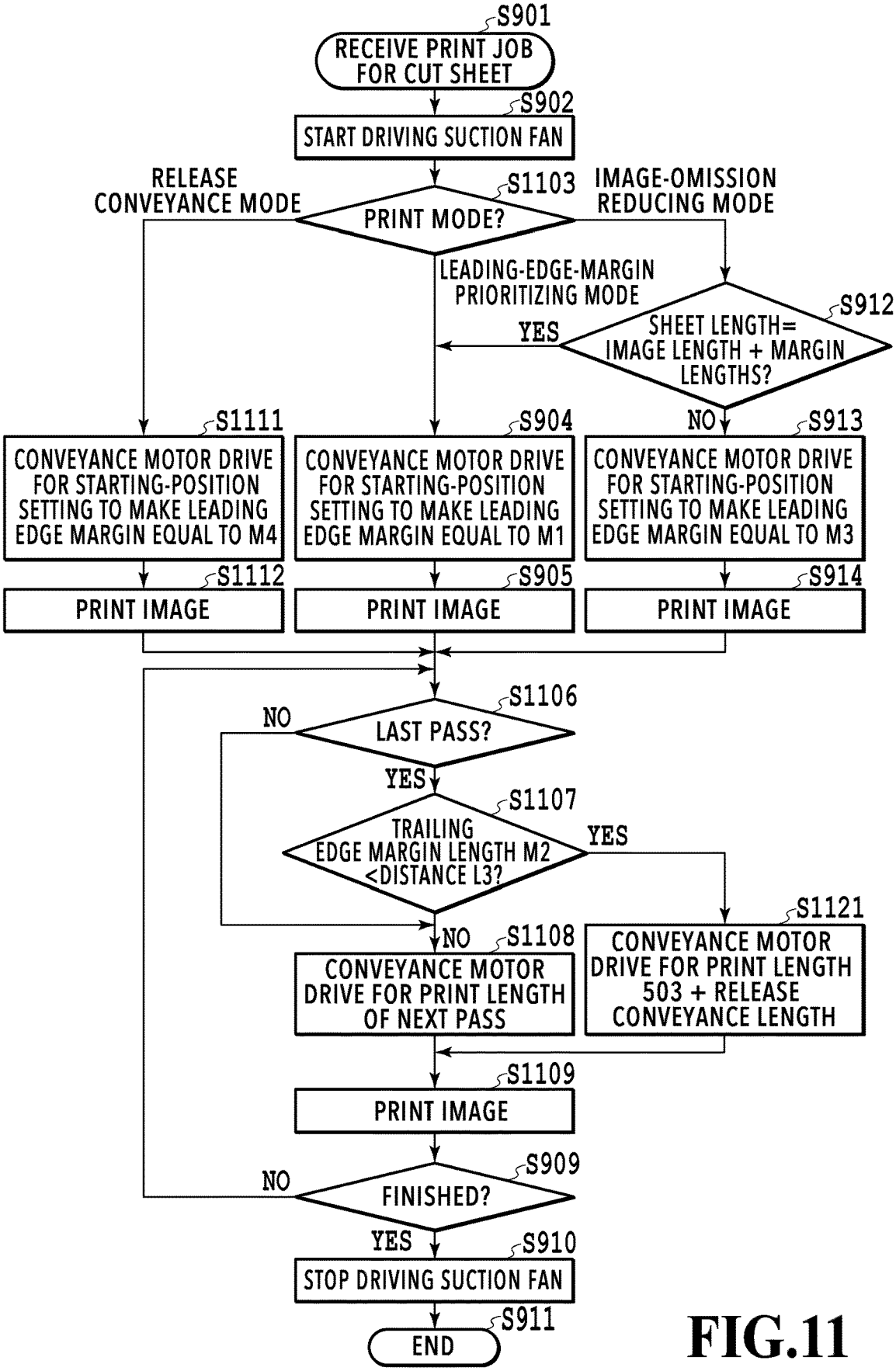
FIG. 11 is a flowchart illustrating an image printing procedure.

FIG. 11 is a diagram illustrating an example of a flowchart in this embodiment. The print mode described in this embodiment can be set as the release conveyance mode, separately from the image-omission reducing mode and leading-edge-margin prioritizing mode described in embodiment 1. The same processes as in FIG. 9 are denoted by the same reference signs, and description thereof is omitted.

At step S1103, the main control unit 401 checks the image print mode set by the user with the operation panel 103 or the like. The image-omission reducing mode and the leading-edge-margin prioritizing mode are the same as those described in embodiment 1. In this embodiment, the main control unit 401 determines whether trailing edge margin length M22 included in the print job is shorter than distance L3 stored in advance in a not-illustrated memory or the like (the distance between the nipping point of the conveyance roller pair 31 and the most upstream ejecting ports of the print head 3). If trailing edge margin length M22 is shorter than distance L3, the main control unit 401 determines to perform the release conveyance mode, and the process proceeds to step S1111.

At step S1111, the conveyance control unit 402 drives the conveyance motor 51 to rotate by the degree corresponding to the starting-position setting conveyance that makes the leading edge margin equal to M4. Here, leading edge margin length M4 is equal to sheet length L—(trailing edge margin length M21+image length 501) as described above. Then, image printing is performed at step S1112.

At step S1106, it is determined whether the current pass is the last pass. If the current pass is not the last pass, the process proceeds to step S1108, where the conveyance control unit 402 drives the conveyance motor by the degree corresponding to the print length of the next pass, and image printing is performed at step S1109. These processes are repeated until the current pass is determined to be the last pass.

If the current pass is determined to be the last pass, the conveyance control unit 402, at step S1107, determines whether trailing edge margin length M2 included in the print job is shorter than distance L3. If trailing edge margin length M2 is not shorter than distance L3, the process proceeds to step S1108 as in the case of other passes. On the other hand, if trailing edge margin length M2 included in the print job (in other words, trailing edge margin length M22) is shorter than distance L3, the process proceeds to step S1121, where conveyance is performed in a state where the print medium 201 is released from the nipping by the conveyance roller 1 and the driven roller 2. Specifically, conveyance is performed by the length corresponding to print length 503 of the last pass and the length of the release conveyance. Then, the process proceeds to step S1109, where image printing is performed.

When printing for the last pass is finished, driving the suction fan 52 is stopped at step S910. As described earlier, during image printing, the print medium 201 is held by the suction force of the suction fan 52 connected to the platen 6 and hangs down from the front of the platen 6. When driving the suction fan is stopped, the print medium 201 is released from the suction force by the platen 6. The printing apparatus 100 in this embodiment does not have a member for nipping and conveying the print medium 201 that would work after the suction and holding by the platen 6 is stopped until the print medium 201 is held on the stack unit. Thus, the print medium 201 is discharged from the discharge opening by its own weight and held on the stack unit.

As has been described above, in this embodiment, in a case where an image is printed on a print medium 201 in a state where the print medium 201 is not nipped by the conveyance roller 1 and the driven roller 2, the leading edge margin length is changed to sheet length L—(trailing edge margin length M21+image length 501) to print the image. As a result, the positional relationship between print length 502 of pass (n−1) and print length 503 of the last pass (n) becomes appropriate, reducing the possibility of occurrence of a streak on the printed image. In addition, this embodiment makes it possible to print an image with a less trailing edge margin length than that of the configuration in embodiment 1, reducing the possibility of occurrence of an image omission.

Note that in this embodiment, description has been provided for the configuration in which the print medium 201 is nipped by the conveyance roller pair 31 until pass (n−1) which is one pass before the lass pass, then the print medium 201 is released from the conveyance roller pair 31, and the last pass is printed in a state where the print medium 201 is not nipped. However, the number of scans after the print medium 201 is released from the conveyance roller pair 31 is not limited to one but may be multiple times unless the relative position between the print medium 201 and the print head 3 changes. In other words, after the print medium 201 is released, an image is printed by at least one scan including the last pass. In this case, part of the ejecting ports for ejecting ink used for one scan may be limited, and the image may be completed by multiple scans. In addition, also for image printing performed in a state where the print medium 201 is nipped by the conveyance roller pair, what is called multi-pass printing may be performed in which an image for a unit area is printed by multiple scans.

Note that although in the description, the printing apparatus 100 in this embodiment is an inkjet printing apparatus as an example, the present invention is not limited to the inkjet printing type but is applicable to other print methods in which an image is printed by multiple scans of the print head.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

The present disclosure reduces the possibility of an image omission or a white streak in the conveyance direction of the print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2018-014535, filed Jan. 31, 2018, and No. 2018-239680, filed Dec. 21, 2018, which are hereby incorporated by reference wherein in their entirety.

What is claimed is:

1. An image printing apparatus comprising:

a scan unit configured to scan in a scan direction multiple times to print an image on a print medium;

a conveyance unit configured to convey the print medium in a conveyance direction intersecting the scan direction; and a control unit configured to control the scan unit and the conveyance unit based on image data, wherein the conveyance unit includes a upstream conveyance member configured to convey the print medium and disposed upstream of the scan unit in the conveyance direction but does not include a downstream conveyance member configured to convey the print medium and disposed downstream of the scan unit in the conveyance direction, and wherein the scan unit is capable of scanning at least one time after a trailing edge of the print medium in the conveyance direction passes through the upstream conveyance member.

2. The image printing apparatus according to claim 1, further comprising an obtaining unit configured to obtain a trailing edge margin length, wherein in a case where the trailing edge margin length is shorter than a predetermined threshold, the control unit controls the scan unit so as to scan at least one time after the trailing edge of the print medium passes through the upstream conveyance member, and wherein in a case where the trailing edge margin length is equal to or longer than the predetermined threshold, the control unit controls the scan unit so as not to scan after the trailing edge of the print medium passes through the upstream conveyance member.

3. The image printing apparatus according to claim 2, wherein the obtaining unit obtains the trailing edge margin length based on a print job including the image data.

4. The image printing apparatus according to claim 3, wherein the obtaining unit obtains an image length in the conveyance direction based on the print job, and wherein the control unit sets a leading edge margin length based on the trailing edge margin length and the image length and controls the scan unit and the conveyance unit such that the image is printed with the set leading edge margin length.

5. The image printing apparatus according to claim 4, wherein the control unit sets the leading edge margin length to a length obtained based on the image length, the predetermined length, and a length of the print medium in the conveyance direction.

6. The image printing apparatus according to claim 5, further comprising a detection unit configured to detect the length of the print medium in the conveyance direction.

7. The image printing apparatus according to claim 6, wherein the detection unit includes (1) a first detection unit configured to detect the print medium at a position upstream, in the conveyance direction, of the upstream conveyance member, and (2) a second detection unit configured to detect the print medium at a position downstream of the upstream conveyance member in the conveyance direction, and wherein the detection unit detects the length of the print medium, based on a position of the trailing edge of the print medium detected by the first detection unit, a position of a leading edge of the print medium detected by the second detection unit, and a conveyance amount from the position at which the trailing edge of the print medium is detected by the first detection unit to the position at which the leading edge of the print medium is detected by the second detection unit.

8. The image printing apparatus according to claim 2, wherein in the case where the trailing edge margin length is shorter than the predetermined threshold, the control unit controls the scan unit and the conveyance unit such that a length between a trailing edge of the image printed on the print medium in the conveyance direction and the trailing edge of the print medium in the conveyance direction is a predetermined length which is shorter than the predetermined threshold.

9. The image printing apparatus according to claim 2, wherein in a case where the trailing edge margin length is equal to or longer than the predetermined threshold, the control unit controls the scan unit and the conveyance unit such that the image is printed from a leading edge of the image to the trailing edge of the image in the conveyance direction in a state where the print medium is nipped by the upstream conveyance member.

10. The image printing apparatus according to claim 2, wherein the predetermined length is a trailing edge margin length corresponding to a position to which the print medium is conveyed by being released by the upstream conveyance member.

11. The image printing apparatus according to claim 1, wherein the scan unit includes a print head and a carriage upon which is mounted the print head.

12. The image printing apparatus according to claim 1, wherein the image is printed by the scan unit scanning a unit area on the print medium multiple times.

13. The image printing apparatus according to claim 1, wherein the upstream conveyance member is a roller pair.

14. The image printing apparatus according to claim 1, further comprising a platen configured to support the print medium from a back surface of the print medium.

15. The image printing apparatus according to claim 14, further comprising a generation unit configured to generate a holding force at the platen for holding the print medium.

16. The image printing apparatus according to claim 15, wherein the generation unit generates a suction force at the platen using a suction fan.

17. The image printing apparatus according to claim 15, wherein after a print operation for printing the image on the print medium by the scan unit is finished, when the generation unit stops generating the holding force, the print medium is discharged by the weight of the print medium.

18. The image printing apparatus according to claim 1, wherein the image printing apparatus is an inkjet printing apparatus configured to print the image on the print medium by repeating (1) a print operation of printing an image on the print medium while making the scan unit scan the print medium in the scan direction, wherein upon the scan unit is mounted a print head having multiple ejecting ports configured to eject ink and arrayed in the conveyance direction, and (2) a conveyance operation of conveying the print medium in the conveyance direction by the conveyance unit.

19. A control method for an image printing apparatus including (a) a scan unit configured to scan in a scan direction multiple times to print an image on a print medium, and (b) a conveyance unit configured to convey the print medium in a conveyance direction intersecting the scan direction, the conveyance unit including a upstream conveyance member configured to convey the print medium and disposed upstream of the scan unit in the conveyance direction but not including a downstream conveyance member configured to convey the print medium and disposed downstream of the scan unit in the conveyance direction, the control method comprising:

a conveyance step of conveying the print medium by the conveyance unit; and a scanning step of scanning at least one time for printing the image after a trailing edge of the print medium in the conveyance direction passes through the upstream conveyance member.

* * * * *